US005992176A

United States Patent [19]

Arbogast

[11] Patent Number: 5,992,176

[45] Date of Patent: Nov. 30, 1999

[54] SHOULDER CLUTCH

[76] Inventor: Gina M. R. Arbogast, 45-450A Pua Inia St., Kaneohe, Hi. 96744

[21] Appl. No.: 09/010,559

[22] Filed: Jan. 22, 1998

[51] Int. Cl.[6] ..... A44C 1/00

[52] U.S. Cl. ..... 63/20; 2/268; 2/460; 224/264

[58] Field of Search ..... 63/20; 2/459, 460, 2/461, 268; 224/264

[56] References Cited

U.S. PATENT DOCUMENTS

| | | | |
|---|---|---|---|
| 3,710,391 | 1/1973 | McGlynn . | |
| 4,040,147 | 8/1977 | King . | |
| 4,575,874 | 3/1986 | Johnson . | |
| 4,879,768 | 11/1989 | McClees et al. . | |
| 5,085,060 | 2/1992 | Matushita | 63/20 X |
| 5,441,188 | 8/1995 | Rosenstein | 224/264 |
| 5,626,507 | 5/1997 | Gillen . | |

*Primary Examiner*—Terry Lee Melius
*Assistant Examiner*—William L. Miller
*Attorney, Agent, or Firm*—Patent & Trademark Services; Thomas Zack; Joseph H. McGlynn

[57] ABSTRACT

A jewelry item having a top member pivotally joined by a hinge to a lower base member used to retain a handbag's shoulder strap in place to the clothing of a user. The top and base members are curved lengthwise to resemble the natural curvature of a user's shoulder. A latch on the top can engage a mating member on the base member to lock the the top and base members together when closed. A fastener on the base can attach the jewelry item to the clothing of a user at their shoulder. Several different designs and materials are disclosed for the exposed upper surface of the top member to exhibit and resemble a fine piece of jewelry. This jewelry item may be worn along or used to retain the shoulder strap of a handbag to a user.

5 Claims, 1 Drawing Sheet

SHOULDER CLUTCH

BACKGROUND OF THE INVENTION

Anyone who has ever carried a shoulder mounted handbag knows that, as the user moves, there is a tendency for the shoulder strap to slip off the user's shoulder. To lessen this tendency shoulder strap pads have been developed that engage the bearing part of the handbag's shoulder strap. A flap or other foldable closure which fits over the engaged shoulder strap may form a part of such shoulder pads. The present invention relates to an improvement in such enclosure shoulder pads wherein a jewelry item is used to both hold a handbag's shoulder strap and to act as a jewelry piece that can be attached to the user's clothing all as more fully described hereafter.

DESCRIPTION OF THE PRIOR ART

Pads used to cushion and retain shoulder straps are known. For example, in U.S. Pat. No. 3,710,391 to McGlynn there is a base plate with a strap holding clip having a hold down pivotally mounted arm and appropriate pads between the user and the base plate.

In the Johnson invention (U.S. Pat. No. 4,575,874) the foldable shoulder strap pad having hook and loop fasteners for the pad and frictional elements on the pad to prevent displacement along the engaged strap segment.

The McClees et al reference (U.S. Pat. No. 4,879,768) discloses a triangular or wedge shaped non-slip strap pad which is anatomically and biomechanically designed to take advantage of the user's shoulder.

And in the Gillen patent (U.S. Pat. No. 5,626,507) the pad for shoulder straps includes a fluid-filled envelope which can slid over the strap and be positioned on the users shoulder. The present invention provides for an improved dual function foldable shoulder worn jewelry item that can act to hold the shoulder strap of a user's handbag and also function to resemble a fine piece of jewelry attached to an item of clothing all as more further set forth in this specification.

SUMMARY OF THE INVENTION

This invention relates to a foldable jewelry item which can engage a user's handbag shoulder strap and act as a fine piece of jewelry attached to the user's clothing.

It is the primary object of the present invention to provide for an improved clothing attachable device which can function to both hold the shoulder strap of a handbag and to act as a fine jewelry item.

Another object is to provide for such a device that encloses the shoulder strap of a user's handbag by engaging the strap on its top and bottom.

These and other objects and advantages of the present invention will become apparent to readers from a consideration of the ensuing description and the accompanying drawings.

DESCRIPTION OF THE PREFERRED EMBODIMENT

Figure 1:
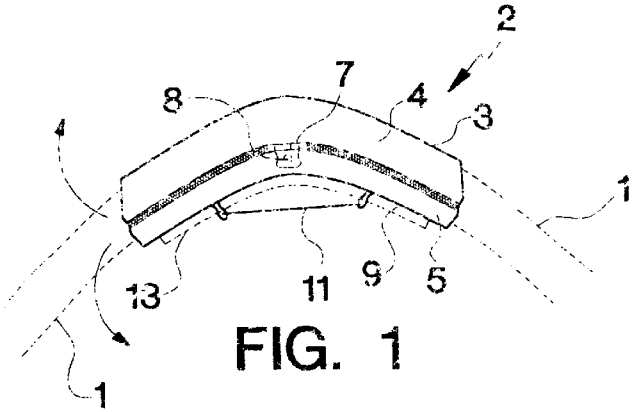
FIG. 1 is a side view of the invention's preferred embodiment when closed over a user's shoulder strap.

FIG. 1 is a side view of the invention's preferred embodiment when closed over a user's shoulder strap 1 shown in dotted line format. This strap is connected to a conventional user's handbag at both of its lower ends and acts to vertically support the handbag when carried by a user. Clearly other shoulder strap carried items could also be used with this invention. As shown item 2 has the shoulder strap 1 sandwiched between the item's upper concave shaped top surface metallic member 3 with its top surface 4 and a lower complementarily shaped concave bottom metallic base member 5. At the interfacing surfaces between the top and base members is a hook and eye latch 7 or other appropriate fastener fixed to the top member 3 and extending down base member 5. At the interfacing surfaces between the top and base members is a hook and eye latch 7 or other appropriate fastener fixed to the top member 3 and extending down and slightly over the bottom member to engage a protruding surface pin 8 fixed to the front side of member 5. The concave configuration of the top and bottom members was chosen to resemble the outline of a typical user's upper shoulder, when view from the side, to thus permit a flush engagement between the shoulder and the lower surface 9 of the base member 5.

Also depicted is the horizontally disposed straight stick pin hardware 11 fixed to bottom surface 9 (by soldering or otherwise) that can be used to attach the item to the user's clothing on the shoulder (e.g., one of the shoulder pads). Optionally, a soft resilient thin cushion pad 13 (shown by dotted lines) preferably smaller is surface area than the base surface may be fixed to this surface 9 with appropriate holes for the protruding pin hardware 11. This pad acts as a cushion between item 2 and the user's shoulder.

Figure 2:
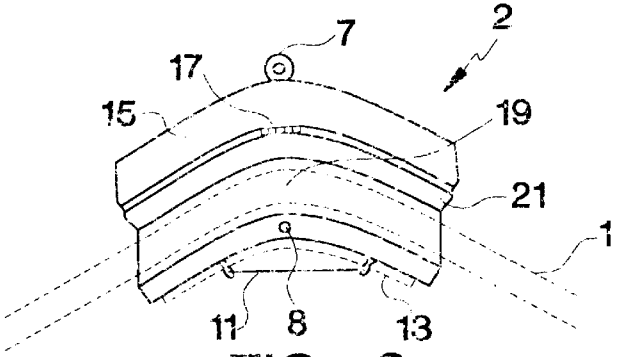
FIG. 2 is a side view of the invention's preferred embodiment when in an opened state with the user's shoulder strap inserted.

FIG. 2 is a side view of the invention's preferred embodiment when in an opened state with the user's handbag shoulder strap 1 (shown in dotted line format) inserted. In this open view the underside 15 of the upper surface 4 of member 3 shown in FIG. 1 is visible along with the hinge 17 that joins the upper and lower members 3 and 5, respectively, together and permits them to fold over each other with the strap 1 between them. Also, shown is the upper smooth concave surface 19 of the lower member 5 which bears against and forms a seat for the in place strap 1. At the back the strap 1 between them. Also, shown is the upper smooth concave surface 19 of the lower member 5 which bears against and forms a seat for the in place strap 1. At the back edge of lower base member 5 the hinge supporting rear edge 21 extends upward at approximately a right angle to surface 19 along its entire length. This edge 21 provides a supporting surface on which the base part of hinge 17 may be affixed.

Figure 3:
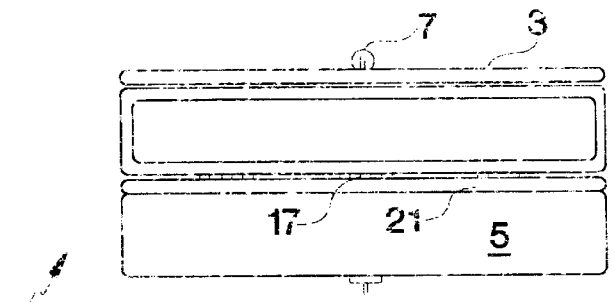
FIG. 3 shows a side view looking in the opposite direction from FIG. 1 showing the opened jewelry item's upper exterior silver plated surface and its lower shoulder engaging surface.

FIG. 3 shows a side view looking in the opposite direction from FIG. 1 showing the opened jewelry item 2 with its upper surface 4 now having an exterior silver plated surface and its lower shoulder engaging surface 5. Essentially the silver plated upper surface is covering the plain upper surface 4 shown in FIG. 1 except than in this case the surface is partially or totally plated with silver material to provide a decorative visible outer design. The remainder parts of the item 2 may also be coated with a silver colored material to blend in with the top surface 4. Alternately, the top surface 4 could be gold plated in place of the silver plate and monogrammed with either material or have a scrolled surface with a raised center rectangular box like outline.

Figure 4:
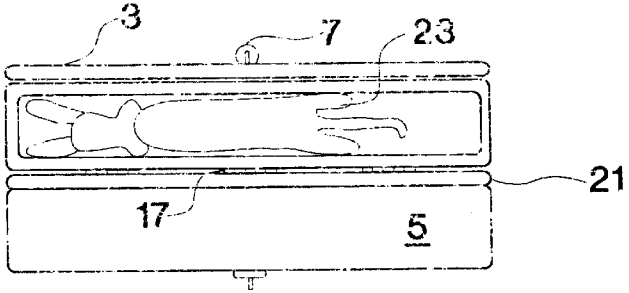
FIG. 4 shows a side view looking in the opposite direction from FIG. 1 showing the opened jewelry item's upper exterior leopard embellished designed surface and its lower shoulder engaging surface.

FIG. 4 shows a side view looking in the opposite direction from FIG. 1 showing the opened jewelry item's upper exterior surface having a leopard embellished designed surface and its lower shoulder engaging surface. Like FIG. 3, this second illustrated alternative surface covering leopard embellished design surface 23 is located on the upper surface 4 to be clearly visible to others as the jewelry item 2 is pinned to the shoulder portion of a user's clothing.

Figure 5:
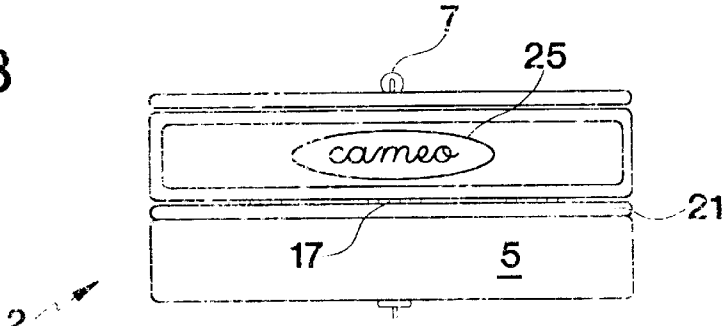
FIG. 5 shows a side view looking in the opposite direction from FIG. 1 showing the opened jewelry item's upper exterior silver with black cameo embedded designed surface and its lower shoulder engaging surface.

FIG. 5 shows a side view looking in the opposite direction from FIG. 1 showing pinned to the shoulder portion of a user's clothing.

FIG. 5 shows a side view looking in the opposite direction from FIG. 1 showing the opened jewelry item's upper exterior silver with still another surface covering, the black cameo 25 embedded designed surface Like FIGS. 3 and 4 this cameo surface is an alternate possible surface covering for surface 4. Other types of covering surfaces could also be used on surface 4 such as those with mother of pearl centers or any other visually pleasing surface such as might be found on fine jewelry.

It should be clear that applicant has no intention to limit their invention to any specific type of covering for the upper surface 4. It may include any of the three different coverings shown in FIGS. 3–5 or any of those mentioned plus still others too numerous to be included. Essentially any type of jewelry covering can be used on surface 4 to provide the look of fine jewelry. Thus, this invention not only provides for a fine piece of jewelry which can be worn alone but also for a jewelry piece that can function to be attached to a user's clothing to hold the shoulder strap of handbag or other hung item to the user. When used as a strap retainer, item 2 insures the strap will not slip from the user's shoulder while all the time providing a visually pleasing sight to all observers.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A jewelry device comprising:

a jewelry item having a lower base member with a length pivotally attached to an upper top member having a length, the length of said top member extending substantially in the same direction as the length of the base member;

said base member length having a curvature and said top member having substantially the same curvature as the base member along the length of the top member;

said top member having an upper surface with a decorative design, fastener pin means on the base member for attaching the jewelry item to a shoulder portion of clothing, said pin means having a length extending in substantially the same direction as the length of said base member and the length of said top member; and latch means on the item for holding the pivotally attached upper top member to the lower base member when closed and placed thereon, said top and base members being adapted to hold part of a shoulder strap handbag therebetween when closed on each other.

2. The device as claimed in claim 1, wherein said top member upper surface is made with a precious metal.

3. The apparatus as claimed in claim 2, wherein said precious metal is silver.

4. The apparatus as claimed in claim 1, wherein said design of said top member upper surface is an embedded design.

5. The apparatus as claimed in claim 1, wherein said design of said top member upper surface is an embellished design.

* * * * *